United States Patent [19]

Gray

[11] 4,405,088

[45] Sep. 20, 1983

[54] ADAPTOR FOR DISPOSABLE CANS FOR SIPHON-TYPE SPRAY PAINT GUNS

[76] Inventor: James W. Gray, 4600 N. Bear Canyon Rd., Tucson, Ariz. 85715

[21] Appl. No.: 245,742

[22] Filed: Mar. 20, 1981

[51] Int. Cl.[3] ..... B05B 7/30

[52] U.S. Cl. ..... 239/302; 220/307; 239/DIG. 14

[58] Field of Search ..... 222/464; 220/307, 352, 220/85 V; 239/142, 144, 302, 340, 366, 368, 369, 375, DIG. 14, 310, 318; 206/229

[56] References Cited

U.S. PATENT DOCUMENTS

| | | | |
|---|---|---|---|
| 442,785 | 12/1880 | Schoettl | 239/366 |
| 3,182,866 | 5/1965 | Rowe | 222/464 |
| 3,358,875 | 12/1967 | Ekstrom | 220/307 X |
| 3,593,921 | 7/1971 | Boltic | 239/318 |
| 3,714,967 | 2/1973 | Zupan | 222/464 X |
| 3,863,843 | 2/1975 | Hechler | 239/318 |
| 3,942,680 | 3/1976 | Seeley et al. | 239/318 X |
| 4,355,763 | 10/1982 | Brandt | 239/302 |

*Primary Examiner*—Andres Kashnikow

*Attorney, Agent, or Firm*—J. Michael McClanahan

[57] ABSTRACT

An adaptor for utilizing disposable type containers of paint with a siphon-type spray paint gun wherein after the usual paint can that is attached to the commercially available spray paint guns is removed, the rapid placement and quick removal adaptor attaches to the spray gun siphon tube in a fixed configuration, the adaptor configured to receive and secure a disposable type container filled with paint in order that small paint jobs or touch-up painting may be accomplished more efficiently. The means by which the adaptor attaches to the spray gun siphon tube additionally includes a vent for venting the interior of the disposable can from which paint is removed for spraying.

3 Claims, 3 Drawing Figures

ADAPTOR FOR DISPOSABLE CANS FOR SIPHON-TYPE SPRAY PAINT GUNS

BACKGROUND OF THE INVENTION

It has been found that in operations where small amounts of spray painting is done, for example, an automobile body and paint shop, that it becomes a major, expensive, and wasteful undertaking to prepare a spray paint gun for spraying a prepared surface when the amount of painting to be accomplished is not great, such as an automobile door panel or the like.

In the past, the touch-up paint operator must prepare the paint in the spray gun paint container which is part of the apparatus of the spray gun, accomplish the painting, and then clean the spray gun, including the paint container. This means that the operator must expend the time of not only cleaning the gun itself by running a paint or lacquer thinner through it, but in addition, cleaning the can that holds the paint. This is wasteful of paint or lacquer thinner and time consuming and as a result, ends up as an added expense to the paint shop operator.

Now it has been known by the spray paint operators in touch-up type operations to place paint in a paper cup and with one hand holding the spray gun, bring the cup of paint under the siphon-tube and thereby accomplish the touch-up job. However, this method causes problems which may be easily forseen, but through perhaps inadvertent forgetfulness on the part of the operator, may cause a great deal of mess. Such an example utilizing the above method would be where the operator attempted to turn the spray can sideways which is a normal operation because of the spray pattern, whereupon the operator finds himself with a handful of paint. Other obvious problems are the increased chances of sloshing paint out of the open cup such that in many cases the chances of making a mess are sufficient that it is not worthwhile to take the chance.

In the prior art, inventors have devised various configurations for spray gun paint cup cover such as shown by the patent to Zupan, U.S. Pat. No. 3,714,967 wherein Zupan details a cup cover attaching to the paint container in a permanent relationship where the can cover has a pair of overlapping radial bosses on opposite sides of the cover to engage the paint can.

Similarly, Boltic, in U.S. Pat. No. 3,593,921 details means by which a paint container in which the paint is purchased, is readily attached to the spray gun, Boltic showing primarily a pair of hold-down clamps.

However, these means do not alleviate the problem of supplying a quick, inexpensive method by which a small or touch-up spray paint job may be performed.

Accordingly, there exists a need to provide a means by which inexpensive disposable cans may be adapted readily to the spray gun for spraying a small amount of paint while presenting a structure that does not spill paint readily from the disposable can interior when it is in place, and after the painting is accomplished, may be removed easily and the can discarded.

SUMMARY OF THE INVENTION

The present invention comprises a circular disk-like adaptor to receive disposable type can containers holding paint for use with siphon-type spray paint guns, the adaptor designed to attach to the spray gun siphon-tube in an easy, efficient, and fast manner where the means for attachment to the siphon tube also includes means to vent air through an opening in the adaptor, the means for attachment and venting comprising a threaded screw transverse the axis of the circular disk-like adaptor to engage the paint gun siphon tube in the opening, the opening being in a teardrop shape to permit venting thereabout and secure the siphon tube therein.

The adaptor receives the top of an open container, the adaptor having means there to secure the container top ridge in place by a groove formed in the circular circumference of the adaptor, and a readily accessible locking mechanism engages the side of the can immediately below the bottom surface of the disk-like adaptor additionally secures the container in place.

Accordingly, it is an object of the subject invention to provide an adaptor to receive disposable type containers of paint for attachment to a spray gun siphon tube for painting jobs whereby the container may be disposed of after the job is accomplished.

It is another object of the subject invention to provide a means whereby an adaptor receives and secures a disposable can of paint, which adaptor is secured to a paint gun siphon tube in a rapid manner and may be removed as easily.

DETAILED DESCRIPTION OF THE PREFERRED EMBODIMENT

Figure 1:
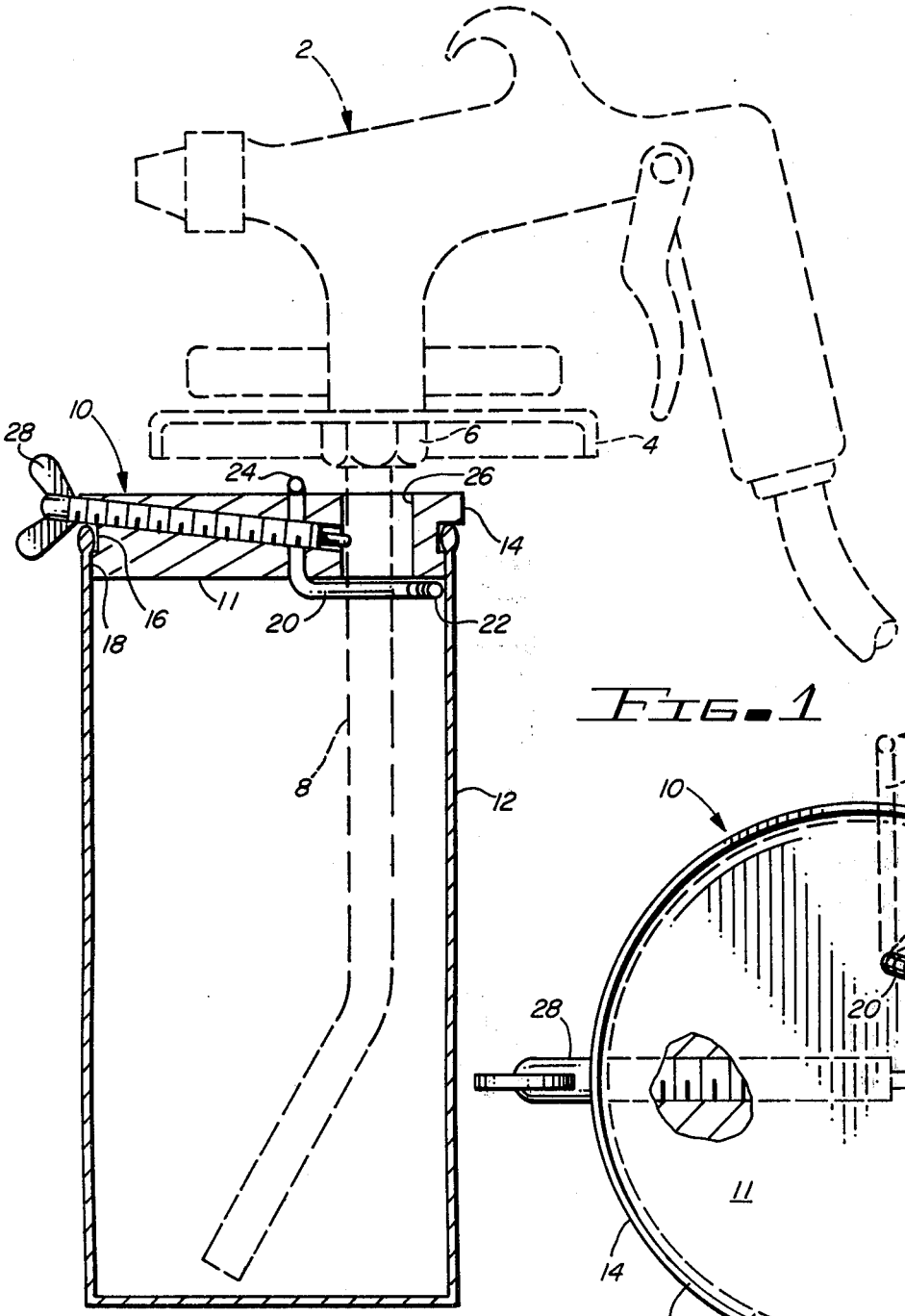
FIG. 1 is a cross-sectioned side view of the subject adaptor for disposable cans for siphon-type spray paint guns shown in place in a spray gun application with the attached disposable container.

Referring now to FIG. 1, a cross-sectioned side view of the subject inventive adaptor for disposable cans for siphon-type spray paint cans is shown in place in a spray gun application having attached the disposable paint container where the spray gun and the disposable paint container is shown in relief. Referring firstly to the spray gun 2, the normal commonly available and oft-used siphon-type of spray gun is shown where, in pertinent part, the usual upper lid or cover 4 utilized with the can normally used to hold paint for spraying is shown with the paint can absent. In the subject application of Applicant's invention, the usual spray paint can lid is not used nor does it serve a function relative to the subject invention, although it may remain in place.

Immediately below the lid 4 is holding nut 6, also part of the usual spray gun apparatus. Holding nut 6 secures the spray gun siphon tube 8 and lid 4 to spray gun 2 and is one of the usual and normal parts of the conventional siphon-type spray paint gun.

Applicant's invention 10 is secured to siphon tube 8 at a place upon siphon tube 8 which is primarily determined by external factors, such as the length of the siphon tube 8 and the height of disposable can 12. It is anticipated that the operator of the subject invention should prefer that the end of siphon tube 8 be as near the bottom of disposable can 12 as possible. Disposable can 12 may be any type of container a person may want to utilize, for example, it could be a soft drink, beer, or other beverage metal container where the top has been removed or any other can such as the metal cans that foods are processed in, or any other similar type of device requiring only that it be open at the top and be of such length that it is compatable with the length of siphon tube 8. This means that the siphon can 12 can be rather short if desired since the invention could attach itself at any point along the siphon tube 8 or, it could be as illustrated in FIG. 1, almost as long as the siphon tube itself. Clearly, nothing would be gained by using an extremely long disposable can 12 relative to siphon tube 8 since if disposable can 12 were too long, obviously there would be paint in the bottom that would never be sprayed, defeating the purpose of the invention.

Looking now at the subject invention, the adaptor 10 for disposable cans comprises firstly the circular disk-like top 11 which is adapted to receive disposable can 12 and to that end, consists of, at its circular periphery, three different stepped diameters. Firstly, the upper and the largest diameter is shown by the largest circular diameter 14 which in turn steps down to the groove 16 having smallest circular diameter, and then steps up a slight amount to the middle circular diameter 18. The purpose for the varying diameters is that the largest circular diameter 14 presents a stop to the placing of the inventive top 11 onto a disposable can. The smallest circular diameter groove 16 is adapted to receive the bead which many cans have at the top of their opening, the bead usually made by rolling the top of the can over onto its sides. The middle circular diameter 18 is adapted to nest against the inside periphery of the disposable can 12. It is anticipated that both the groove 16 and the middle circular-diameter 18 will be engaged by the disposable can bead and side in a rather snug, somewhat tight relationship, such as to present a watertight (or paint-tight) seal. One additional purpose for utilizing the groove 16 receiving the can bead is to present added resistance to the disposable can 12 being involuntarily removed from the top 11. In the event that a disposable can 12 should not have a top bead, and as an added safety measure, an additional locking mechanism is attached to top 11 to engage the side of disposable can 12 as follows.

Piercing the top 11 in the axial direction, but not at its center, is locking mechanism 20 which comprises, in its simplest configuration, a rigid structure, nominally metal wire, pivotal about the opening through which it penetrates top 11, to engage the side of the can 12 by engagement element 22. Engagement element 22 is a continuation of the piece of metal wire locking mechanism 20 which, when locking mechanism 20 is rotated by means of a handle 24 (only partly shown) located on the outside of top 11, engagement element 22 is forcibly urged against the side of disposable can 12 to secure it in place. In many cases, disposable can 12 is made of very thin sheet aluminum plate and engagement element 22 is capable of deforming the disposable can 12, which of course enhances the holding of the disposable can 12 in place.

Continuing, it is seen that siphon tube 8 pierces the top 11 through a teardrop shaped opening 26, siphon tube 8 being secured in the teardrop portion of the opening by means of threaded screw 28. Threaded screw 28 penetrates the top 11 from the opposite side, commencing on the surface of the largest circular diameter 14 and through the top 11 to come out at the inside surface of opening 26 opposite the narrowing portion of teardrop opening 26, approximately mid-way in the disk-like top thickness. The obvious purpose of threaded screw 8 is to forcibly engage and hold in place top 11 upon the siphon tube by engaging the side of siphon tube 8. The opening is made transversely across the majority of top 11 to accommodate threaded screw 28, the opening being threaded itself so that threaded screw 28 may be screwed in or out by its wing type top with no requirement that an additional nut be placed upon the threaded screw. In that respect, it is obvious that top 11 must comprise a material sufficiently durable to receive threads in order that the total length, or any part thereof, of the opening to receive threaded screw 28, may be threaded. In this respect it has been determined that plastic, nylon, metal, or any other similar type material may be utilized for top 11.

It is also noted that the opening 26 does not secure siphon tube 8 in an air tight manner, but in fact, is intended to provide an air venting hole into the disposable can 12 interior to allow air to replace the paint as it is removed. It is noted that the subject invention performs no relational function with the lid 4 which is part and parcel of the original spray gun apparatus.

Figure 2:
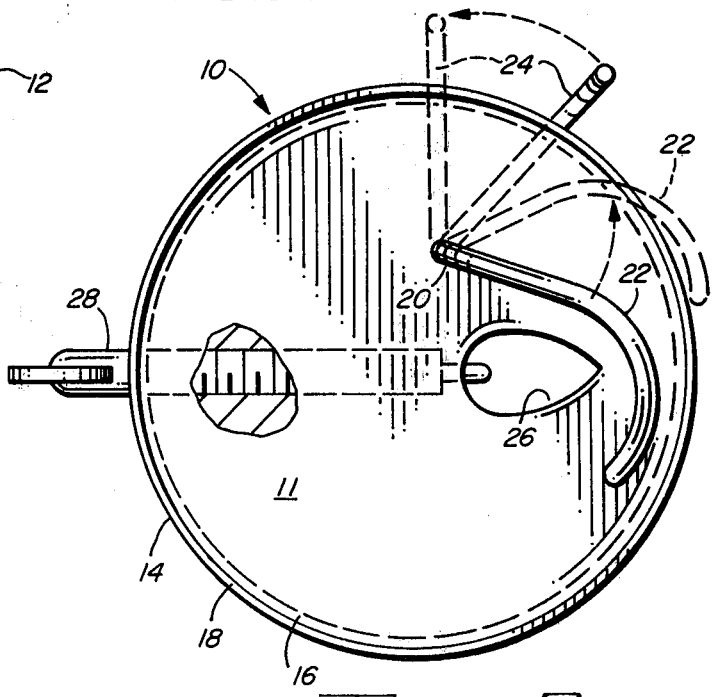
FIG. 2 is a bottom view of the subject invention.

Moving now to FIG. 2, a bottom view of adaptor 10 is shown. Opening 26, adapted to receive siphon tube 8, is shown in a teardrop configuration together with threaded screw 28 which pierces the side of the top 10 to engage the siphon tube when it is in place through opening 26. Also shown is locking mechanism 20 penetrating the top at a point not in the center of the top 11, but off to a side. Noted here is that the engagement element 22 lies, in one position, between opening 26 and the middle circular diameter 18 with its handle 24 shown, in dotted form, on the opposite side of top 11 where it is hidden by the top and then in full relief where not. In dotted form is a second position of handle 24 which has been moved counterclockwise and thereby moves the engagement element 22 also counterclockwise to a position beyond the circumference of the largest circular diameter 14. Of course, this is achieved only because disposable can 12 is not in place on the top 11, and obviously, engagement element 22 would engage the side of the can and inhibit further movement. Engagement element 22 is so shaped that as it engages the side of the disposable can, the effect is to force the wire to bend even more in the direction of its curve such as to place pressure on the wire between the opening receiving the wire and the side of the disposable can.

Figure 3:
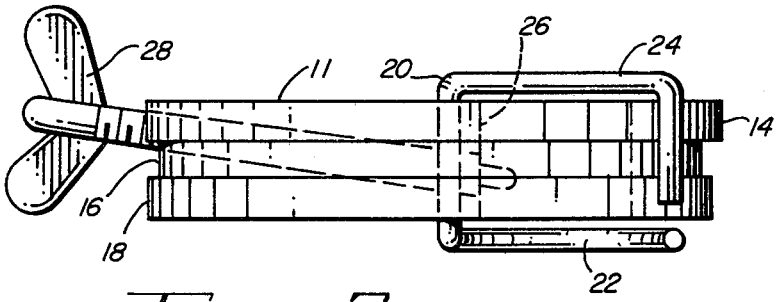
FIG. 3 is a side view of the subject invention.

Referring now to FIG. 3, a side view of the subject invention is shown absent the disposable can and spray gun. All of the elements of the invention have been identified prior, the threaded screw 28, the three diameters on the side of the top, largest circular diameter 14, smallest circular diameter groove 16 adapted to receive the bead at the top of a disposable can, and the middle circular diameter 18 which engages the inside of the can. Similarly, opening 26 adapted to receive siphon tube 8 as well as an opening for air has been detailed. The only part which has not been shown in its completeness is the remainder of handle 24 of locking mechanism 20, which seen in its preferred embodiment, curves around to be located along the side of the disposable can 12 (when it is in place) and thus make it easier in order to lock the engagement element 22 against the side of disposable can.

While the preferred embodiment of the invention has been shown and described, it would be understood that there is no intent to limit the invention by such disclosure, but rather it is intended to cover all modifications and alternate constructions falling within the spirit and the scope of the invention as defined in the appended Claims.

I claim:

1. An attachment for siphon-type spray paint guns having a siphon tube to utilize disposable open containers holding paint comprising an adaptor adapted to attach to the siphon-type spray paint gun siphon tube and adapted to receive in a securing configuration an associated disposable open container, said adaptor defining a circular shaped disk with a circumferential stepped shoulder, said adaptor adapted to reside in the opening of the associated disposable container with the container opening abutting said stepped shoulder, said adaptor including an opening to receive the siphon tube and means forcibly engaging and holding in place the siphon tube, and means to forcibly engage the side wall of the associated disposable container, said means to engage the side wall of the associated disposable container defines a wire penetrating said adaptor and emerging from both sides thereof, said wire being a handle on one side of the adaptorand an arcuate shaped bow on the other side of the adaptor, said wire pivotal through said adaptor whereby in rotating the handle, the arcuate shaped bow rotates into the wall of the associated disposable container and engages the container and thereby holds the container in place.

2. The attachment for siphon-type spray paint guns as defined in claim 1 wherein said opening in said adaptor to receive the siphon tube defines a tear shaped opening whereby the siphon tube, when engaged by said holding means, is forcibly urged against the narrowing two sides of the opening.

3. The attachment for siphon-type spray paint guns as defined in claim 2 wherein said adaptor means forcibly engaging and holding in place the siphon tube against the opening defines a threaded screw, said threaded screw threads engaging complimentary threads formed in said adaptor, said threaded screw forcibly engaging the siphon tube and holding the siphon tube in said opening.

* * * * *